US007395621B2

(12) United States Patent
Carter

(10) Patent No.: US 7,395,621 B2
(45) Date of Patent: Jul. 8, 2008

(54) FLAT FOLDING PROMOTIONAL STRUCTURE

(76) Inventor: Anna G. Carter, 1914 Sterling Rd., Charlotte, NC (US) 28209

( * ) Notice: Subject to any disclaimer, the term of this patent is extended or adjusted under 35 U.S.C. 154(b) by 0 days.

(21) Appl. No.: 11/565,927

(22) Filed: Dec. 1, 2006

(65) Prior Publication Data

US 2008/0127536 A1 Jun. 5, 2008

(51) Int. Cl.
*G09F 1/00* (2006.01)

(52) U.S. Cl. ..... 40/124.08; 446/80; 446/389; 446/71; 229/115; 40/789; 40/124.14

(58) Field of Classification Search ..... 40/124.08, 40/124.01, 124.09, 124.14, 124.16, 124.06, 40/538, 539; 220/6, 7, 4.28; 206/459.5
See application file for complete search history.

(56) References Cited

U.S. PATENT DOCUMENTS

| | | | | | |
|---|---|---|---|---|---|
| 1,667,180 | A | * | 4/1928 | Willson | 102/355 |
| 2,020,196 | A | * | 11/1935 | Mallgraf | 446/478 |
| 2,232,953 | A | * | 2/1941 | Mallgraf | 446/80 |
| 3,134,708 | A | | 5/1964 | Lohnes | |
| 3,267,597 | A | | 8/1966 | Jannes | |
| 4,319,418 | A | * | 3/1982 | Transport | 40/124.14 |
| 4,365,432 | A | | 12/1982 | McCauley et al. | |
| 4,854,060 | A | | 8/1989 | Corbo et al. | |
| 4,946,414 | A | * | 8/1990 | Zimmer | 446/71 |
| 5,396,985 | A | * | 3/1995 | Seki | 206/459.5 |
| 5,562,520 | A | | 10/1996 | Pridonoff et al. | |
| 5,678,339 | A | | 10/1997 | Marventano | |
| 6,427,371 | B2 | | 8/2002 | Olson et al. | |
| 6,467,209 | B1 | | 10/2002 | Vickers | |
| 2003/0230012 | A1 | | 12/2003 | Mouyal | |
| 2005/0132621 | A1 | | 6/2005 | Bostick, II | |
| 2006/0156593 | A1 | | 7/2006 | Caravacci et al. | |

FOREIGN PATENT DOCUMENTS

| | | |
|---|---|---|
| JP | 9295636 A | 11/1997 |

* cited by examiner

*Primary Examiner*—Lesley D. Morris
*Assistant Examiner*—Shin Kim
(74) *Attorney, Agent, or Firm*—Summa, Allan & Additon, P.A.

(57) ABSTRACT

The invention is a promotional structure, such as a greeting card, which is collapsible to fit into a flat envelope for mailing, and which unfolds into the shape of a recognizable type of building, such as a house. Some of the panels are flexibly joined to one another while others (or portions of others) carry reusable fasteners, such as ribbons corresponding to complementary holes on adjacent panels. When the structure is unfolded and the fasteners join the corresponding panels, the panels define the building's shape and its promotional theme. The design provides a structure well suited for distributing promotional material in a medium that is different than traditional greeting cards or brochures, and the structure may be fabricated either from a plurality of panels secured to each other or from the die-cutting and scoring of a single sheet of material.

26 Claims, 3 Drawing Sheets

FLAT FOLDING PROMOTIONAL STRUCTURE

BACKGROUND

The present invention relates generally to the field of collapsible structural displays. Specifically, the invention relates to a promotional structure containing messages, graphics, or photographs that can be collapsed to a flattened form so as to enable distribution in a mailing envelope.

Commercial promotional materials take many forms. Traditional promotional literature and brochures serve the purpose of distributing a message to an audience. Printed materials such as these can be inexpensive to produce in bulk quantities and are additionally inexpensive to distribute relative to other promotional options because they may be sent in standard mailing envelopes.

On the other hand, though, a great number of printed promotional materials are ineffective in capturing the recipient's attention and helping to create awareness of the promoted product, organization, or event because the common use of paper materials makes it difficult to engage the recipient's interest. Even those materials that may be more effective in catching a person's attention are still in the form of a flat, printed form that can easily be lost in a pile of other mailings or papers. As a result, despite the general cost effectiveness of the medium, printed materials are not an effective solution to promotional needs.

On the other end of the spectrum, a variety of custom branded products such as water bottles, calendars, duffel bags, pens, mousepads, golf balls, t-shirts, picture frames, etc. are currently available and can be effective marketing tools. Depending on the message to be conveyed or the audience targeted, products such as these can grab the attention of the intended audience and thus provide awareness of the product, organization, or event.

Such promotional products also have drawbacks, though. Although they are more likely to be kept by the recipient and are thus more effective in creating awareness, because they are designed for a functional purpose first and a promotional purpose second, they are less effective in conveying information. Further, custom branded products are generally more expensive than promotional materials such as literature and brochures. Additionally, branded products are often irregularly-shaped, heavy, fragile, or otherwise burdensome so as to make bulk mailings more costly than the distribution of printed materials.

Related problems exist in the field of non-commercial mailings. Many individuals and families enjoy sending photographs, personalized greeting cards, and personalized gifts to keep in touch with friends and relatives. The personal nature of these kinds of materials makes them more memorable and better able to engage the recipient than commercial promotional material, but these mailings suffer from many of the same problems as commercial promotional materials. Much like promotional literature, greeting cards, newsletters, and photographs are still two-dimensional items that can easily be lost in a pile of mail or other papers. More substantial items such as picture frames and photo cubes are more likely to be retained and displayed, but like custom branded products these items can be bulky, fragile, and expensive.

Of course, there are some products that have been introduced in an attempt to address at least a portion of the problems detailed here such as pop-up cards and books and foldable picture frames and displays. One such example is embodied in U.S. Pat. No. 4,854,060 to Corbo et al. Corbo discloses a self-erecting photo display that can display a number of photographs, is inexpensive to produce, and can be flattened and inserted into a mailing envelope. The Corbo design thus provides a means for distributing photographs that can be displayed and kept without losing the economy or ease of shipping of printed materials.

The self-erecting photo display of the Corbo patent still does not fully address the problems with other promotional materials. First, the Corbo design discloses only a rectangular solid shape where other, more imaginative forms may be better able to create interest. Further, the self-erecting design of the photo display makes it easy to erect, but it also makes the display easy to flatten. As a result, although the design springs into a three-dimensional form, it would still be too easy to flatten the display to put aside just as any flat literature could be.

Accordingly, there still exists a need for a product that addresses the competing needs of price and effectiveness but also engages the recipient to more effectively convey the message or theme of the promotion and create a lasting interest in the product, organization, or event promoted.

SUMMARY OF THE INVENTION

In one aspect, the invention is a three-dimensional promotional structure that includes a plurality of design panels that together can be unfolded into the shape of a recognizable type of building, such as a house. Some of the panels are flexibly joined to one another while others (or portions of others) are joined by reusable fasteners such as ribbons. When the structure is unfolded and the fasteners used to connect corresponding panels, the panels define the building's shape and its promotional theme. The design provides a structure well suited for distributing promotional material in a medium that is different than traditional greeting cards or brochures.

In another aspect, the invention is a substantially flat foldable paperboard blank capable of forming a promotional structure. In this embodiment, a single thin sheet of material includes all of the panels that serve as the surfaces of the structure. The blank may be folded and its free edges connected using reusable fasteners such as ribbons to define a three-dimensional display.

In yet another aspect, the invention is a promotional structure formed from at least six photographs. A combination of flexible hinges and at least one ribbon join the photographs to define a three-dimensional display.

The invention differs from typical three-dimensional gifts or promotional items in that it can be produced from inexpensive materials and can be easily shipped. The invention's capability to collapse to a substantially flattened form enables distribution of the structure in a flat mailing envelope. Accordingly, the invention may be an attractive option for the distribution of personal photos and messages or promotional materials due to the cost savings and ease of distribution.

DETAILED DESCRIPTION

The present invention will now be described more fully hereinafter with reference to the accompanying drawings, in which one embodiment of the invention is shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The invention is a promotional structure, such as a greeting card, which is collapsible to fit into a flat envelope for mailing, and which unfolds into a self-supporting structure such as a house. The invention is constructed from a plurality of panels assembled using a combination of flexibly joined or hinged edges and reusable fasteners so that the assembled structure supports itself in the desired shape. Each panel of the structure may also include a photograph, logo, or other design, allowing the structure to convey personal or promotional messages or themes.

Figure 1:
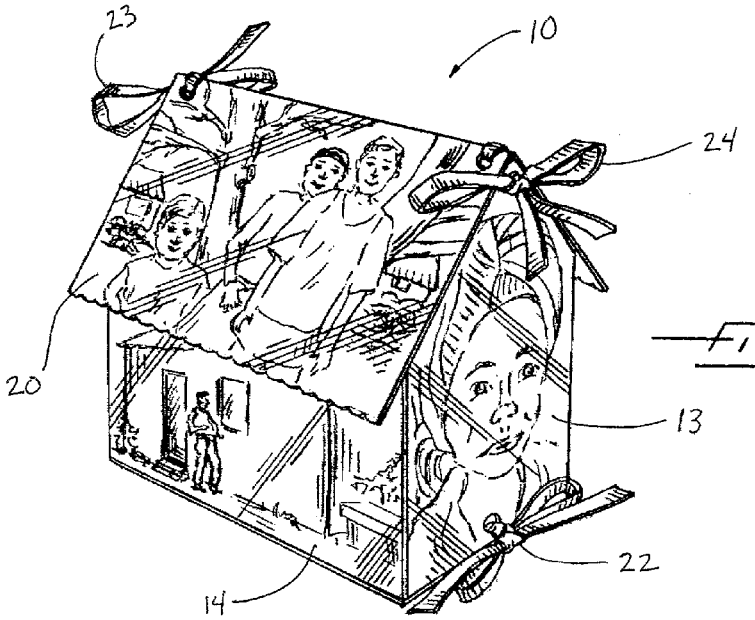
FIG. 1 is a perspective view of the invention depicting the assembled structure.
Figure 2:
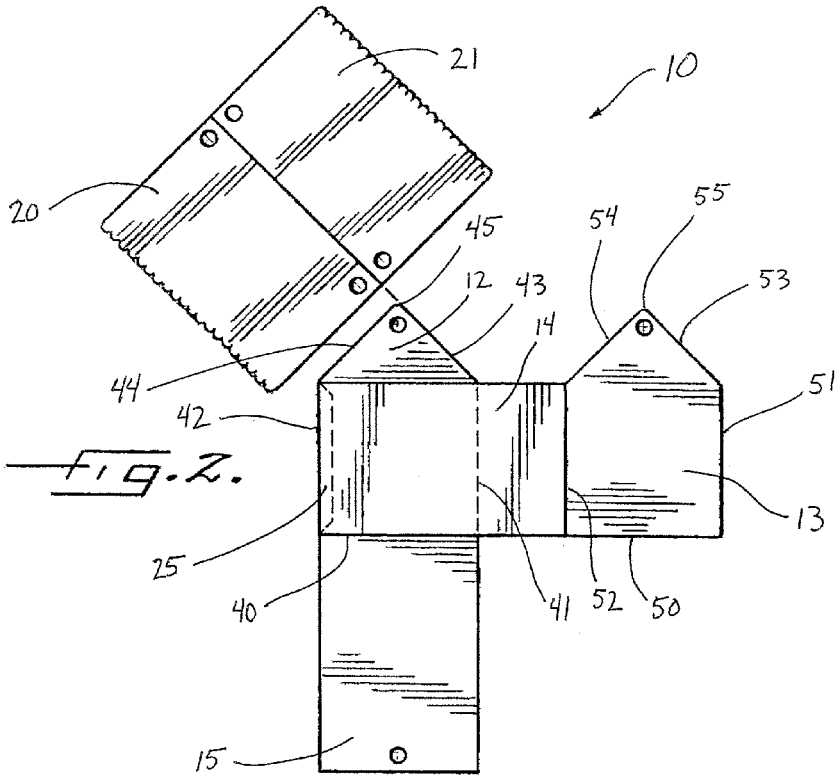
FIG. 2 is a plan view of the invention as a foldable blank.
Figure 3:
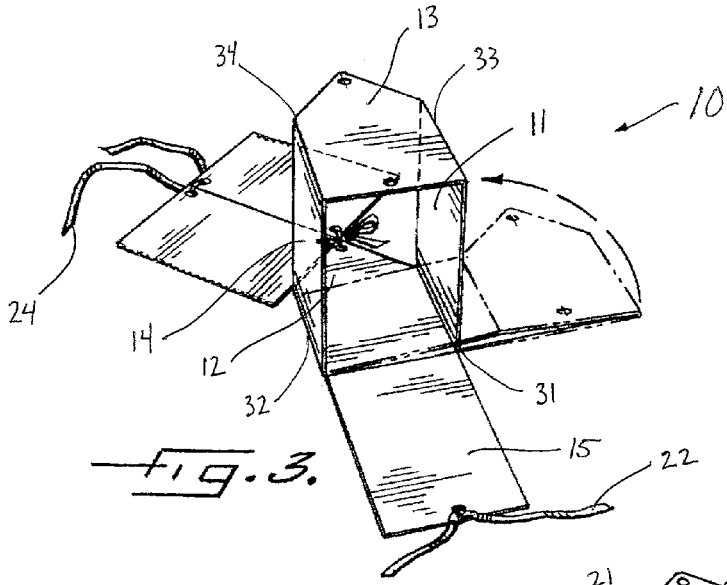
FIG. 3 is a perspective view of the partially assembled structure.

In one embodiment, the invention is a three-dimensional promotional structure 10 fabricated from a plurality of panels as shown in FIGS. 1 and 2. The promotional structure 10 includes a substantially rectangular first side panel 11, a first pentagonal end panel 12 and a second pentagonal end panel 13 connected to opposing edges of the first end panel 11, a substantially rectangular second side panel 14 likewise connected at opposing ends to the first end panel 12 and the second end panel 13, a bottom panel 15 connected to one of the first end panel 12 or the second end panel 13, a first roof panel 20 connected to one of the side panels 11 or 14 or the end panels 12 or 13, and a second roof panel 21 connected to the first roof panel 20.

FIGS. 3 through 6 show each of the panels and their relationship and connection to each other. The first end panel 12 has a bottom edge 40, two side edges 41 and 42, and two top edges 43 and 44 meeting at a vertex 45. Similarly, second end panel 13 has a bottom edge 50, two side edges 51 and 52, and two top edges 53 and 54 meeting at a vertex 55. In the embodiment illustrated in FIGS. 1 through 7, the end panels are irregular pentagons wherein the side edges 41, 42, 51, and 52 are of equal length and are substantially perpendicular to respective bottom edges 40 and 50. Of course, a variety of five-sided shapes may be used to form a three-dimensional structure as described in this aspect of the invention, but irregular pentagons having this shape typically define a structure having a shape suggestive of a house.

The side edge 41 of the first end panel 12 is connected to the first side panel 11 by a first hinge 31 and the side edge 42 is connected to the second side panel 14 by a second hinge 32. Likewise, the side edges 51 and 52 of the second end panel 13 are connected by a third hinge 33 and a fourth hinge 34 to the first side panel 11 and the second side panel 14, respectively. The connection of these four panels 11, 12, 13, and 14 defines a continuous band that serves as the perimeter walls for the promotional structure 10.

The bottom panel 15 is connected to one of the bottom edges 40 or 50 of the end panels 12 or 13, respectively, by a fifth hinge 35 and to the other of the bottom edges 40 or 50 by a fastener 22. These connections of the bottom panel 15 to the continuous band formed of panels 11, 12, 13, and 14 establishes the solid polygonal shape of the promotional structure 10 and further helps the promotional structure 10 to support itself in this shape.

To complete the structure, the roof portion is connected. A first roof panel 20 is connected by a sixth hinge 36 to one of the top edges 43, 44, 53, or 54 of the end panels 12 or 13 or to one of the edges of the side panels 11 or 14. The first roof panel 20 is then connected to at least one of the end panels 12 or 13 by a fastener 23. The second roof panel 21 is connected to the first roof panel 20 by a seventh hinge 37 and to the vertices 45 and 55 of respective end panels 12 and 13 by fasteners 23 and 24. In the embodiment illustrated in FIG. 1 and FIGS. 3 through 7, fasteners 23 and 24 serve to connect both the first roof panel 20 and the second roof panel 22 to the end panels 12 and 13. Similar to the shape of the end panels, the roof panels 20 and 21 may also help to define the shape of a house by extending the unconnected edges of the roof panels 20 and 21 beyond the side panels 11 and 14 as shown in FIG. 1. This shape mimics the eaves of a roof.

Figure 7:
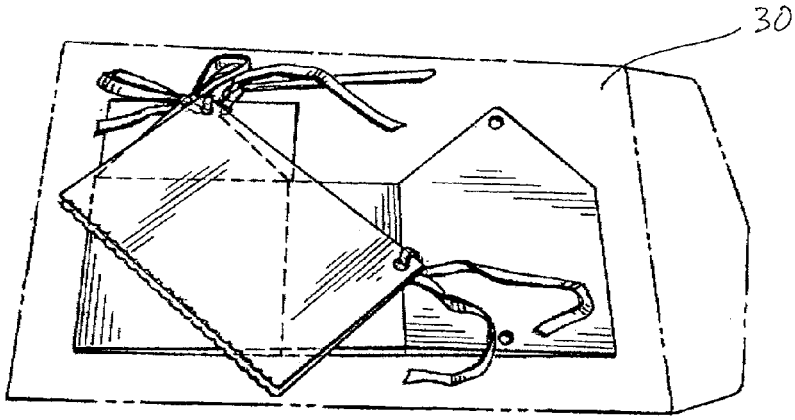
FIG. 7 is a perspective view of the invention depicting the fully collapsed form of the structure in a flat envelope.

The disengagement of the fasteners 22, 23, and 24 allows the promotional structure 10 to collapse to a flattened form capable of being inserted into a flat mailing envelope 30 as shown in FIG. 7. This capability of the invention allows for convenient distribution of the promotional structure 10 by avoiding the cost and burden of shipping three-dimensional objects.

The hinges used to connect the panels may take a variety of forms. They may be common metal or plastic mechanical hinges, lengths of adhesive tape, or anything otherwise known in the art that is jointed or flexible such that it connects adjacent panels but still allows the connected panels to rotate relative to each other. The hinges may allow 360 degrees of rotation of the connected panels so that the panels may fold on top of each other to effect the collapse of the promotional structure 10.

Likewise, a variety of fasteners known in the art may be used, including buttons, snaps, adhesive, tape, or ribbon. In the embodiment illustrated in FIG. 1 and FIGS. 3 through 6, the fasteners comprise a ribbon in one of the panels to be connected, an opening for receiving the ribbon in the other panel to be connected, and a knot in the ribbon to secure the two panels together. As shown in the Figures, the knot may be a releasable bow so that the panels may be easily connected or disconnected to readily change the shape of the structure between a self-supporting solid polygon and a flattened form.

Compared to other kinds of fasteners, the use of ribbons may require some assembly on the part of the recipient, but the structure is generally easy to assemble. Further, the labor on the part of the recipient may serve a marketing function in requiring the recipient to devote their attention to the promotional structure 10. The act of building the structure and the time required to do so may help to create a personal connection with the structure, perhaps also creating a connection to the message embodied in the structure. Further, as ribbons often convey a gift or holiday connotation, the use of ribbons as fasteners may also make the promotional structure 10 marketable as a gift item.

As shown in FIG. 1, the outward-facing surfaces of the panels may contain a visual design, such as a drawing, logo, message, or photograph. There are a number of ways such a visual design may be included. For example, one or more of the visible panel surfaces in the assembled structure may be a photograph. Alternatively, one or more of the panels may be composed of a paper backing onto which a photograph is secured. This variation may provide greater rigidity than a photograph alone if a heavyweight paper or card stock is used as the paper backing.

In another embodiment, the invention is a substantially flat foldable paperboard blank as shown in FIG. 2 that is capable of forming a promotional structure 10. In this embodiment, the invention includes a substantially rectangular first side panel 11, a first pentagonal end panel 12 and a second pentagonal end panel 13 connected to opposing edges of the first end panel 11, a substantially rectangular second side panel 14 connected to the second end panel 13, a tab 25 connected to the second side panel 14 for connecting the second side panel 14 to the first end panel 12, a bottom panel 15 connected to one of the first end panel 12 or the second end panel 13, a first roof panel 20 connected to one of the side panels 11 or 14 or the end panels 12 or 13, and a second roof panel 21 connected to the first roof panel 20.

The first end panel has a bottom edge 40, two side edges 41 and 42, and two top edges 43 and 44 meeting at a vertex 45. Similarly, the second end panel has a bottom edge 50, two side edges 51 and 52, and two top edges 53 and 54 meeting at a vertex 55. In the illustrated embodiment, the end panels are irregular pentagons wherein the side edges 41, 42, 51, and 52 are of equal length and are substantially perpendicular to respective bottom edges 40 and 50.

The side edge 51 of the second end panel 13 is connected to the first side panel 11 and the side edge 52 is connected to the second side panel 14. The edge of the second side panel 14 opposite the edge connected to the second end panel 13 is connected to the tab 25. The side edge 41 of the first end panel 12 is connected to the first side panel 11 and the side edge 42 may then be secured to the tab 25. The connection of these four panels 11, 12, 13, and 14 and the tab 25 defines a flattened continuous band.

The bottom panel 15 is connected to one of the bottom edge 40 of the first end panel 12 or the bottom edge 50 of the second end panel 13. The first roof panel 20 is connected to either one of the top edges 43, 44, 53, or 54 of the end panels 12 or 13 or to one of the edges of the side panels 11 or 14. The second roof panel 21 is then connected to the first roof panel 20.

This embodiment of the invention may include a mailing envelope that completely encloses the foldable blank, thus allowing for the convenient distribution of the promotional structure 10.

The foldable blank may further have a series of scores at the intersection of each pair of connected panels to facilitate the folding of the blank into a three-dimensional, self-supporting promotional structure 10. The scored junctions of adjacent panels may allow 360 degrees of rotation of the connected panels so that the panels may fold on top of each other achieve the flattened form of the promotional structure 10.

Figure 4:
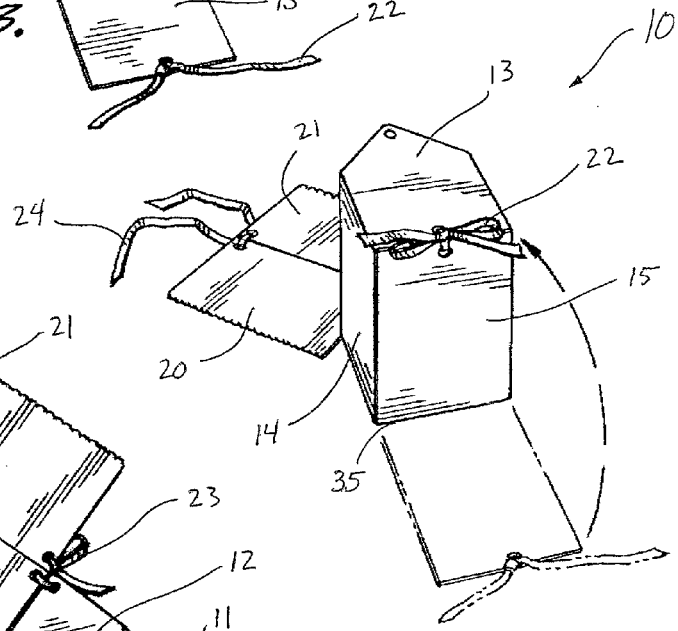
FIG. 4 is a second perspective view of the partially assembled structure.
Figure 5:
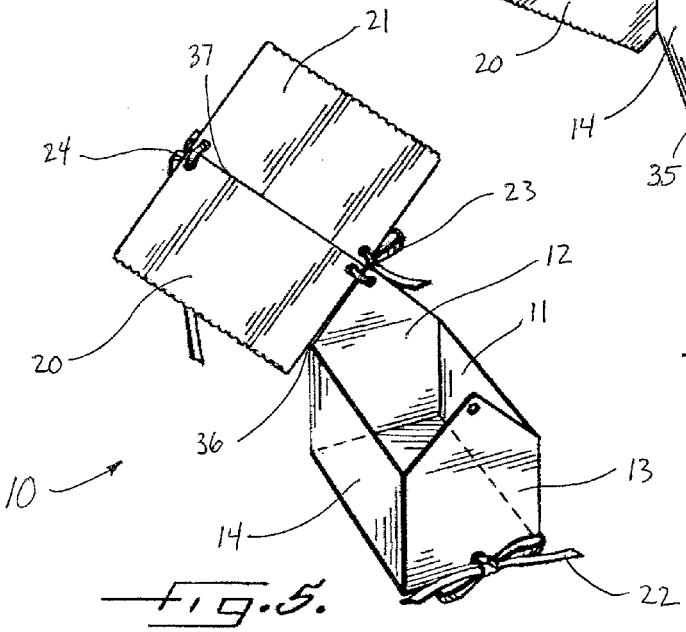
FIG. 5 is a third perspective view of the partially assembled structure.
Figure 6:
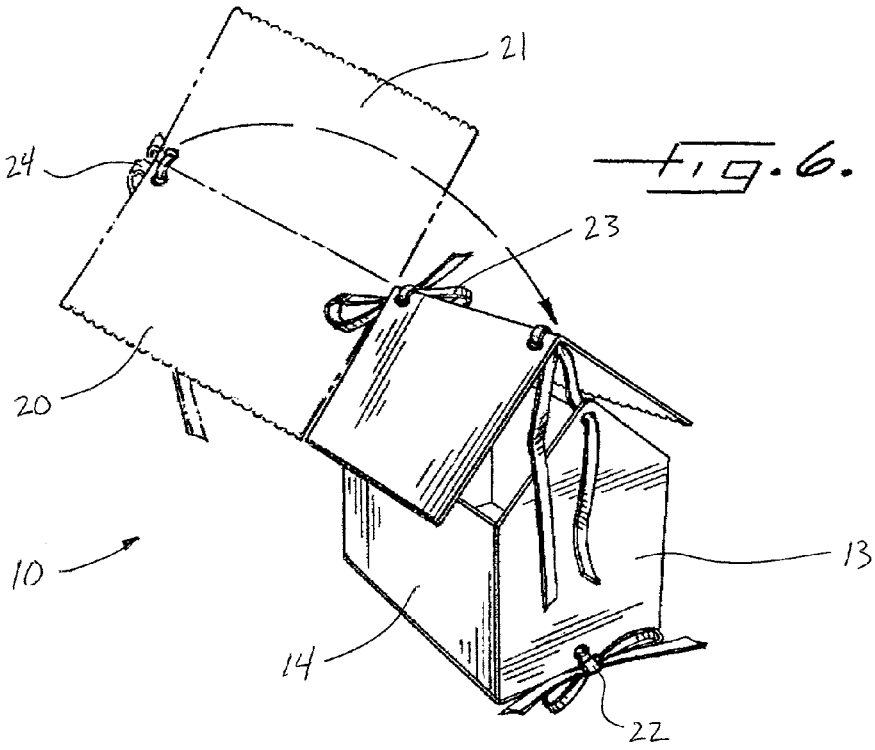
FIG. 6 is a fourth perspective view of the partially assembled structure.

The foldable blank may also include a first fastener 22 secured to the bottom panel 15 and capable of engaging the end panel 12 or 13 not already connected to the bottom panel 15 as shown in FIG. 4. A second fastener 23 may be secured to one or both of the first roof panel 20 or the second roof panel 21 and capable of engaging the vertex 45 of the first end panel 12 as shown in FIG. 5. A third fastener 24 may be secured to one or both of the first roof panel 20 or the second roof panel 21 and capable of engaging the vertex 55 of the second end panel 13 as shown in FIG. 6.

The fasteners 22, 23, and 24 used to secure the panels as indicated may be any fastener known in the art, such as buttons, snaps, adhesive, tape, or ribbon. In the illustrated embodiment, the fasteners comprise a ribbon in one of the panels to be connected and an opening in the other panel to be connected for receiving the ribbon. As shown in FIG. 1 and FIGS. 3 through 6, a knot may be tied as a releasable bow so that the panels may be easily connected or disconnected to readily change the shape of the structure between a self-supporting solid polygon and a flattened form.

As shown in FIG. 1, the outward-facing surfaces of the panels may contain one or more visual designs, such as drawings, logos, messages, or photographs. There are a number of ways such a visual design may be included. For example, one or more of the visible panel surfaces in the assembled structure may be a photograph. Alternatively, one or more of the panels may be composed of a paper backing onto which a photograph is secured.

In yet another embodiment, the invention is a promotional structure 10 formed from at least six photographs or prints. A plurality of flexible hinges joins some but not all of the photographs to one another to define a three-dimensional display, and at least one ribbon joins at least two of the photographs. All of the photographs defining the three-dimensional display may have a common theme so that the promotional structure 10 conveys a promotional message or identifies a particular product, organization, or event. The terms "photograph" and "print" are used herein in a broad sense to describe the illustrated panels and the invention is not limited to literal photographs or items produced on a printing press.

The hinges used may be of the variety of hinges known in the art. For example, the hinges may be lengths of adhesive tape that secure adjacent panels to one another but are flexible so as to allow the panels to pivot with respect to the hinge. As another example, the panels may all be formed from a single sheet of thin material and the hinges may simply be creases or scores in the sheet. The use of these kinds of flexible hinges along with the releasable ribbon connections may allow the three-dimensional display to collapse to a flattened form so that the promotional structure 10 may be inserted into a flat mailing envelope 30 for distribution.

The invention of this embodiment may be produced in a variety of shapes, including a promotional structure 10 having seven photographs connected to form the three-dimensional display. Additionally, as shown in FIG. 1, the variation of this embodiment having seven photographs may be connected in the form of a house.

Finally, the ribbons may be uniquely colored to identify the location on the promotional structure 10 of the connection. For example, a green ribbon may identify that the panel containing that ribbon is the base panel while red ribbons indicate top panels. This system may be helpful in identifying to recipients of the promotional structure how the structure should be assembled or oriented.

The invention claimed is:

1. A three-dimensional promotional structure fabricated from a plurality of panels comprising:

a substantially rectangular first side panel;

a pentagonal first end panel and a pentagonal second end panel each having a bottom edge, two side edges, and two top edges meeting at a vertex, one of said side edges of said first end panel and one of said side edges of said second end panel connected to opposing edges of said first side panel by hinges;

a substantially rectangular second side panel connected to said first end panel by a hinge and connected to said second end panel by a hinge such that said side panels and said end panels form a continuous band;

a substantially rectangular bottom panel connected to said bottom edge of one of said first end panel or said second end panel by a hinge and secured to said bottom edge of the other of said first end panel or said second end panel by a fastener to thereby define a self-supporting solid polygon from said side panels and said end panels;

a first roof panel connected by a hinge to one edge selected from the group consisting of said top edges of said end panels and one edge of said side panels;

said first roof panel being secured to at least one of said end panels by a fastener;

a second roof panel connected to said first roof panel by a hinge and secured to at least one of said end panels by a fastener; and each said fastener comprising a ribbon, a corresponding opening in one of said panels that receives said ribbon, and a knot in said ribbon fixing said ribbon to said opening.

2. A promotional structure according to claim 1 wherein said side edges of said end panels are substantially perpendicular to said bottom edges of said end panels.

3. A promotional structure according to claim 1 wherein when said fasteners are disengaged, said structure is capable of collapsing to form a flat structure capable of being inserted into a flat mailing envelope.

4. A promotional structure according to claim 1 wherein one or more of said panels contain one or more visual designs.

5. A promotional structure according to claim 1 wherein at least one of said panels is a photograph.

6. A promotional structure according to claim 5 wherein all of said panels are photographs.

7. A promotional structure according to claim 1 wherein at least one of said panels comprises a paper backing with a photograph secured thereto.

8. A promotional structure according to claim 7 wherein all of said panels comprise a paper backing with a photograph secured thereto.

9. A substantially flat foldable paperboard blank capable of forming a promotional structure comprising:

a substantially rectangular first side panel;

a pentagonal first end panel and a pentagonal second end panel each having a bottom edge, a first side edge, a second side edge, and two top edges meeting at a vertex, said first side edge of said first end panel and said first side edge of said second end panel connected to opposing edges of said first side panel;

a substantially rectangular second side panel connected to said second side edge of said second end panel;

a tab connected to said second side panel for connecting said second side panel to said second side edge of said first end panel, whereby said connection of said side panels and said end panels defines a flattened continuous band;

a substantially rectangular bottom panel connected to said bottom edge of one of said end panels;

a first roof panel connected to one edge selected from the group consisting of said top edges of said end panels and one edge of said side panels;

a second roof panel connected to said first roof panel;

a first fastener secured to said bottom panel and capable of engaging said bottom edge of one of said first end panel or said second end panel;

a second fastener secured to said first and second roof panels and capable of engaging said vertex of said first end panel; and a third fastener secured to said first and second roof panels and capable of engaging said vertex of said second end panel;

wherein each said fastener comprises a ribbon in one of said connected panels and a corresponding opening in the other of said connected panels for receiving said ribbon.

10. A foldable paperboard blank according to claim 9 wherein said side edges of said end panels are substantially perpendicular to said bottom edges of said end panels.

11. A foldable paperboard blank according to claim 9 wherein said tab connects said second side panel to said first end panel with a layer adhesive.

12. A foldable paperboard blank according to claim 9 wherein said blank having a series of scores at the intersection of each connected panel to facilitate the folding of said blank into a self-supporting structure.

13. A combination comprising a mailing envelope and a foldable paperboard blank according to claim 9 entirely enclosed within said mailing envelope.

14. A foldable paperboard blank according to claim 9 wherein one or more of said panels contain one or more visual designs.

15. A foldable paperboard blank according to claim 9 wherein at least one of said panels is a photograph.

16. A foldable paperboard blank according to claim 15 wherein all of said panels are photographs.

17. A foldable paperboard blank according to claim 9 wherein at least one of said panels comprises a paper backing with a photograph secured thereto.

18. A promotional structure according to claim 17 wherein all of said panels comprise a paper backing with a photograph secured thereto.

19. A promotional structure comprising:

at least six panels, selected from the group consisting of photographs and prints, formed into a three-dimensional display;

a plurality of flexible hinges joining some but not all of said panels to one another in said three-dimensional display; and at least one ribbon joining at least two of said panels to one another in said three-dimensional display.

20. A promotional structure according to claim 19 wherein said three-dimensional display is collapsible for inserting said promotional structure into a flat mailing envelope.

21. A promotional structure according to claim 19 wherein all of said panels have a common theme.

22. A promotional structure according to claim 19 comprising seven photographs formed into a three-dimensional display.

23. A promotional structure according to claim 22 wherein said three-dimensional display is in the form of a house.

24. A promotional structure according to claim 19 wherein said flexible hinges are lengths of adhesive tape.

25. A promotional structure according to claim 19 wherein said flexible hinges are creases in a single sheet of thin material.

26. A promotional structure according to claim 19 wherein said ribbons are colored to identify the features of said three-dimensional display.

* * * * *